US010352639B2

(12) United States Patent
Doty et al.

(10) Patent No.: US 10,352,639 B2
(45) Date of Patent: Jul. 16, 2019

(54) SAFETY MAGAZINE SYSTEM FOR BLANK AMMUNITION

(71) Applicants: Joseph W. Doty, El Cajon, CA (US); David J. Bloom, Santee, CA (US)

(72) Inventors: Joseph W. Doty, El Cajon, CA (US); David J. Bloom, Santee, CA (US)

( * ) Notice: Subject to any disclaimer, the term of this patent is extended or adjusted under 35 U.S.C. 154(b) by 0 days.

(21) Appl. No.: 16/005,929

(22) Filed: Jun. 12, 2018

(65) Prior Publication Data

US 2018/0364001 A1 Dec. 20, 2018

Related U.S. Application Data

(60) Provisional application No. 62/521,001, filed on Jun. 16, 2017.

(51) Int. Cl.
*F41A 17/34* (2006.01)

(52) U.S. Cl.
CPC ..... *F41A 17/34* (2013.01)

(58) Field of Classification Search
CPC ..... F41A 35/00
See application file for complete search history.

(56) References Cited

U.S. PATENT DOCUMENTS 2,355,045 A * 8/1944 Audet ..... F41A 17/38 42/50
4,069,608 A * 1/1978 Jurek ..... F41A 9/71 42/49.02
4,139,958 A * 2/1979 Foote ..... F41A 9/71 42/49.02
5,416,998 A * 5/1995 Martel ..... F41A 17/38 42/49.02
5,452,534 A * 9/1995 Lambie ..... F41A 9/71 42/18
6,070,352 A * 6/2000 Daigle ..... F41A 11/02 42/49.02
7,240,449 B2 * 7/2007 Clifton, Jr. ..... F41A 17/44 42/70.02
8,434,254 B1 * 5/2013 Watchorn ..... F41A 9/65 42/50

(Continued)

*Primary Examiner* — Benjamin P Lee
(74) *Attorney, Agent, or Firm* — McLane Middleton, Professional Association

(57) ABSTRACT

In one aspect, a magazine safety system for preventing loading of a live ammunition cartridge into a firing chamber of a firearm is provided. The firearm has an associated ammunition caliber. The safety system includes a safety block comprising an inner member configured for insertion along an inner surface of a wall of a magazine well of the firearm, the magazine well having an opening for receiving a magazine. An outer member is configured to attach to the inner member along an outer surface of the wall of the magazine well and one or more fasteners secure the inner member to the outer member to secure the wall of the magazine well between the inner member and the outer member. The inner member has a thickness configured reduce an axial extent of the opening to permit insertion of a first magazine sized to carry blank ammunition rounds having a length which is less than live ammunition cartridges having the associated ammunition caliber, while preventing insertion of a second magazine sized to carry live ammunition cartridges having the associated ammunition caliber.

13 Claims, 7 Drawing Sheets

(56) References Cited

U.S. PATENT DOCUMENTS

| | | | | |
|---|---|---|---|---|
| 8,677,880 | B2 * | 3/2014 | Bowles | F41A 9/68 42/50 |
| 8,726,554 | B2 * | 5/2014 | Klassen | F41A 9/71 42/6 |
| 8,898,946 | B1 * | 12/2014 | Johnson | F41A 17/36 42/49.02 |
| 9,188,402 | B2 * | 11/2015 | Giannini | F41A 21/00 |
| 9,261,320 | B2 * | 2/2016 | Campbell | F41A 35/00 |
| 9,683,796 | B2 * | 6/2017 | Addis | F41A 9/64 |
| 9,803,943 | B2 * | 10/2017 | Schafer | F41A 3/66 |
| 10,054,390 | B1 * | 8/2018 | Hane | F41A 5/02 |
| 10,101,109 | B2 * | 10/2018 | Caudle | F41A 11/02 |
| 2010/0154275 | A1 * | 6/2010 | Faifer | F41A 9/61 42/90 |
| 2011/0005115 | A1 * | 1/2011 | Cahill | F41A 9/66 42/49.01 |
| 2013/0097909 | A1 * | 4/2013 | Watchorn | F41A 9/65 42/50 |
| 2014/0075817 | A1 * | 3/2014 | Gomez | F41A 21/48 42/75.02 |
| 2015/0068088 | A1 * | 3/2015 | Souza | F41A 9/71 42/49.02 |
| 2015/0101228 | A1 * | 4/2015 | Giannini | F41A 21/00 42/49.02 |
| 2015/0198404 | A1 * | 7/2015 | Campbell | F41A 35/00 42/70.11 |
| 2017/0146308 | A1 * | 5/2017 | Plumb | F41A 9/65 |

* cited by examiner

SAFETY MAGAZINE SYSTEM FOR BLANK AMMUNITION

CROSS-REFERENCE TO RELATED APPLICATION

This application claims the benefit of priority to U.S. provisional application No. 62/521,001 file Jun. 16, 2017. The aforementioned application is incorporated herein by reference in its entirety.

BACKGROUND

The present development relates to firearm magazines and, more particularly, to a safety magazine system for preventing live ammunition cartridges from inadvertently being loaded into a firearm.

Blank firearm cartridges contain gunpowder but no bullet projectile or shot and are often used when a live cartridge would not be safe, but where it is necessary or desirable to simulate the sound (report) and appearance of gunfire. Such instances where simulated gunfire is used include military or police training or maneuvers, funeral honors, motion pictures, historical reenactments, signaling, and the like.

Because blank cartridges do not contain a bullet projectile or shot, but rather, use paper or plastic wadding to seal the gunpowder into the cartridge, blanks are significantly shorter in length than a live round of a given caliber. However, this does not eliminate the possibility that live cartridges could become mixed with blank cartridges, thereby creating an unsafe situation for persons in the vicinity.

The present disclosure contemplates a new and improved safety magazine system for blank ammunition for holding and feeding blank cartridges into the chamber of a firearm while eliminating the possibility of loading a live cartridge into the chamber.

SUMMARY OF THE INVENTION

In one aspect, a magazine safety system for preventing loading of a live ammunition cartridge into a firing chamber of a firearm is provided. The firearm has an associated ammunition caliber. The safety system includes a safety block comprising an inner member configured for insertion along an inner surface of a wall of a magazine well of the firearm, the magazine well having an opening for receiving a magazine. An outer member is configured to attach to the inner member along an outer surface of the wall of the magazine well and one or more fasteners secure the inner member to the outer member to secure the wall of the magazine well between the inner member and the outer member. The inner member has a thickness configured reduce an axial extent of the opening to permit insertion of a first magazine sized to carry blank ammunition rounds having a length which is less than live ammunition cartridges having the associated ammunition caliber, while preventing insertion of a second magazine sized to carry live ammunition cartridges having the associated ammunition caliber.

In a more limited aspect, the magazine safety system further comprises the first magazine.

In another more limited aspect, the first magazine is a box-type magazine.

In yet another more limited aspect, the first magazine has stepped shape defining a first portion sized to fit within the magazine well when the safety block is secured to the wall of the magazine well and a second portion wider than the first portion which is exterior to the magazine well when the safety block is secured to the wall of the magazine well.

In still another more limited aspect, the inner member is configured for insertion along an inner surface of a fore-end wall of the magazine well and the outer member is attached to the inner member along an outer surface of the fore-end wall of the magazine well.

In yet another more limited aspect, the inner member includes a shoulder portion which is exterior of the magazine well and extends toward the outer member when the safety block is secured to the wall of the magazine well.

In yet another more limited aspect, the outer member includes a transversely extending groove configured to accommodate a rim of the magazine well when the safety block is secured to the wall of the magazine well.

In yet another more limited aspect, the inner member and outer member are formed of a material selected from the group consisting of metals, metal alloys, polymer materials, and composite materials.

In yet another more limited aspect, the one or more fasteners comprise one or more threaded fasteners securing the inner member to the outer member.

In yet another more limited aspect, the one or more threaded fasteners have a specific geometric configuration requiring a complementary tool to attach and remove the block.

In yet another more limited aspect, one or both of the inner member and outer member have a color selected from the group consisting of a bright color, a color which is contrasting with a color of the firearm, and a color which is indicative of safety.

In yet another more limited aspect, one or both of the inner member and outer member are blue in color.

In yet another more limited aspect, one or both of the inner member and outer member are formed of a material which is transparent.

In a further aspect, a method for preventing loading of a live ammunition cartridge into a firing chamber of a firearm, the firearm having an associated ammunition caliber, comprises placing an inner member along an inner surface of a wall of a magazine well of the firearm, the magazine well having an opening for receiving a magazine. An outer member is placed along an outer surface of the wall of the magazine well of the firearm. The inner member is attached to the outer member to secure the wall of the magazine well between the inner member and the outer member, wherein the inner member has a thickness configured reduce an axial extent of the opening to permit insertion of a first magazine sized to carry blank ammunition rounds having a length which is less than live ammunition cartridges having the associated ammunition caliber, while preventing insertion of a second magazine sized to carry live ammunition cartridges having the associated ammunition caliber.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
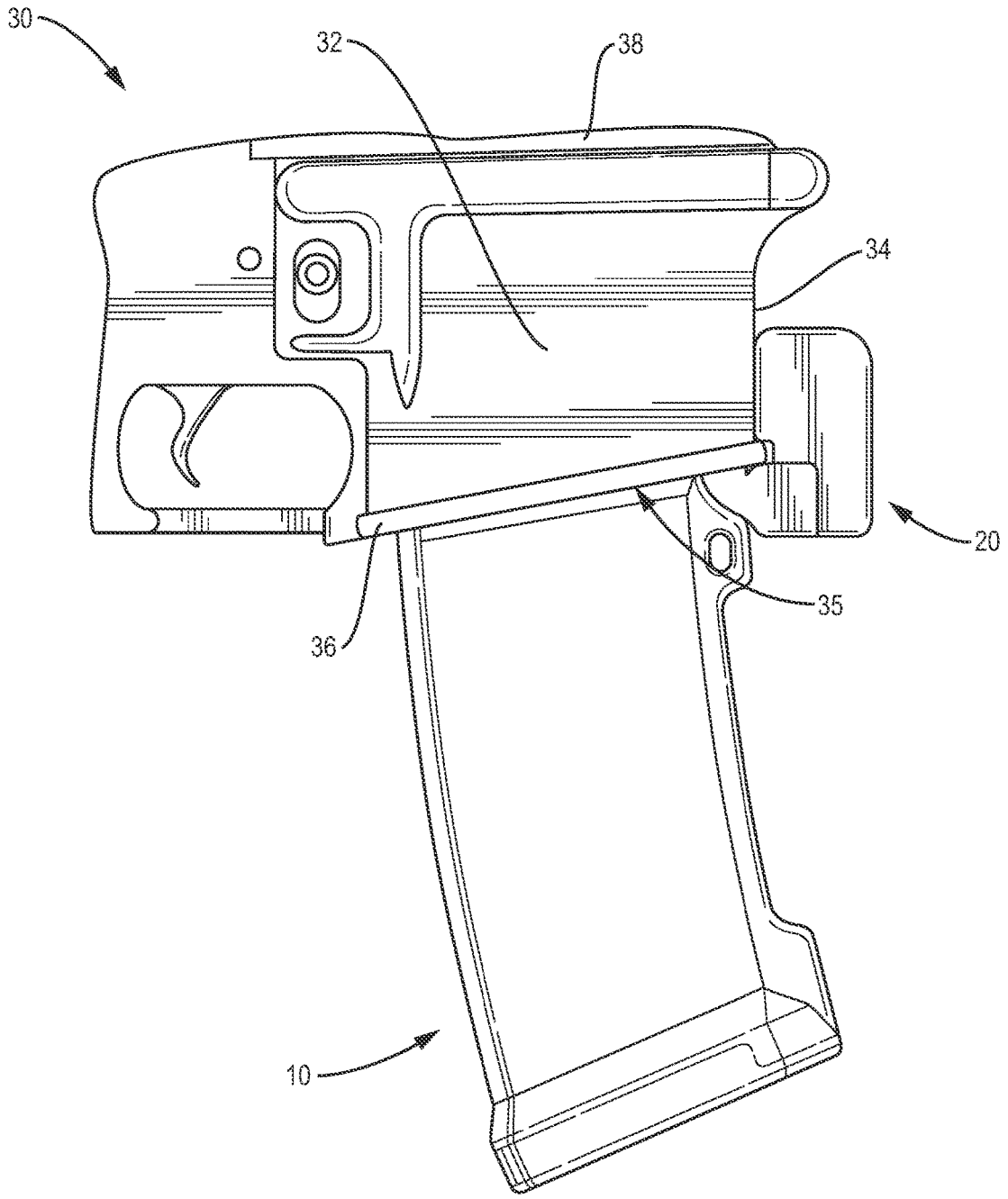
FIG. 1 is a fragmentary view of a firearm with safety magazine with a safety magazine block attached to the forward wall of the magazine firearm magazine well.
Figure 2B:
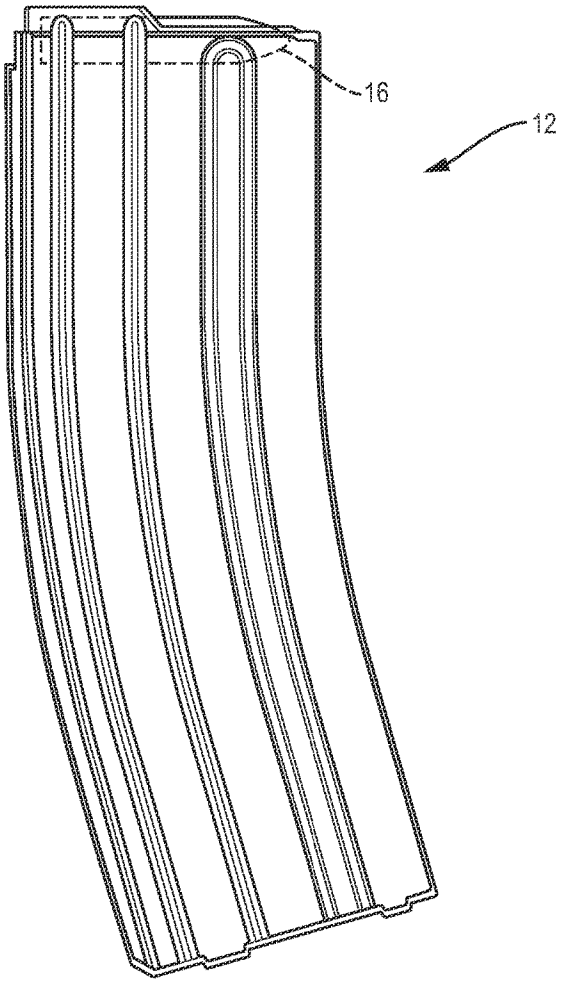
FIGS. 2A and 2B illustrate an exemplary safety magazine in accordance with this disclosure and a standard magazine for line ammunition rounds, respectively.
Figure 2A:
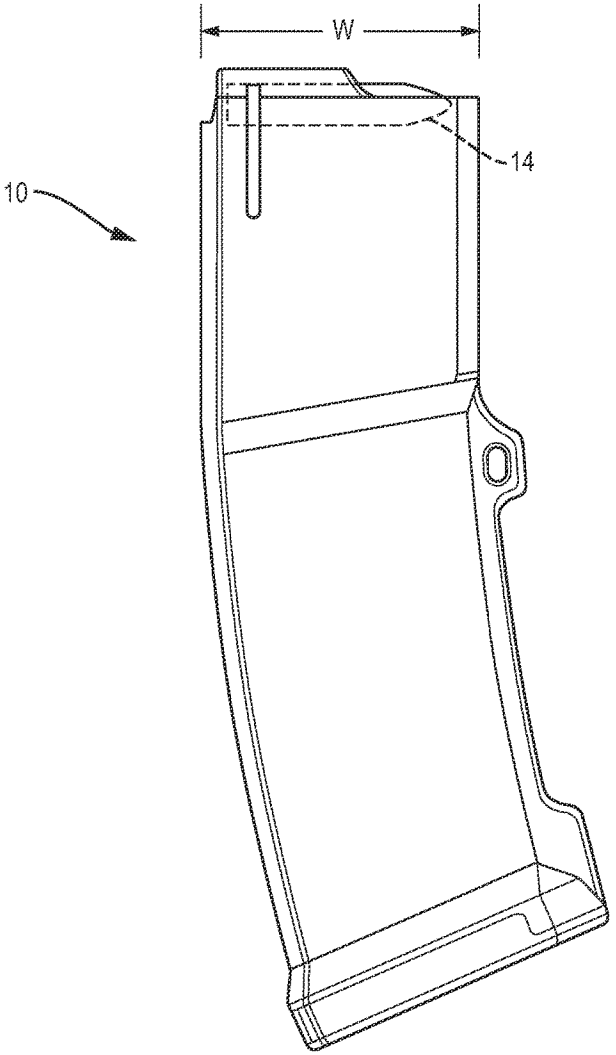

Referring now to the drawings, where like reference numeral refer to like or analogous components throughout the several views, FIG. 1 illustrates a safety magazine 10 for blank ammunition loaded into a magazine well 32 of a weapon 30 with a safety block 20 installed. The magazine well has a lower opening 35 for receiving the magazine 10, and the safety bock 20 is secured to the fore end wall 34 of the magazine well 32. FIGS. 2A and 2B illustrate the safety magazine 10 and a standard magazine 12, respectively. The magazines 10, 12 illustrated herein are detachable box-type magazine although the present development could be adapted for use for firearms employing other detachable magazine types.

Ammunition magazines typically employ a spring and follower to push the cartridges upward and, in combination with some action of the firearm receiver, to feed cartridges into the chamber, as is generally known in the art. The safety magazine 10 in accordance with the present development has a width W that is narrower than the standard magazine 12 to accommodate the size of a blank ammunition round 14, which is shorter than a standard ammunition round 16. By limiting the width of the safety magazine 10 to the size (length) that will accommodate the training rounds 14, but not the longer liver rounds 16, the operator can be certain that a standard round 16 will not accidentally be loaded into the safety magazine 10 during a training event or other event where firing a live projectile would not be safe.

Figure 3:
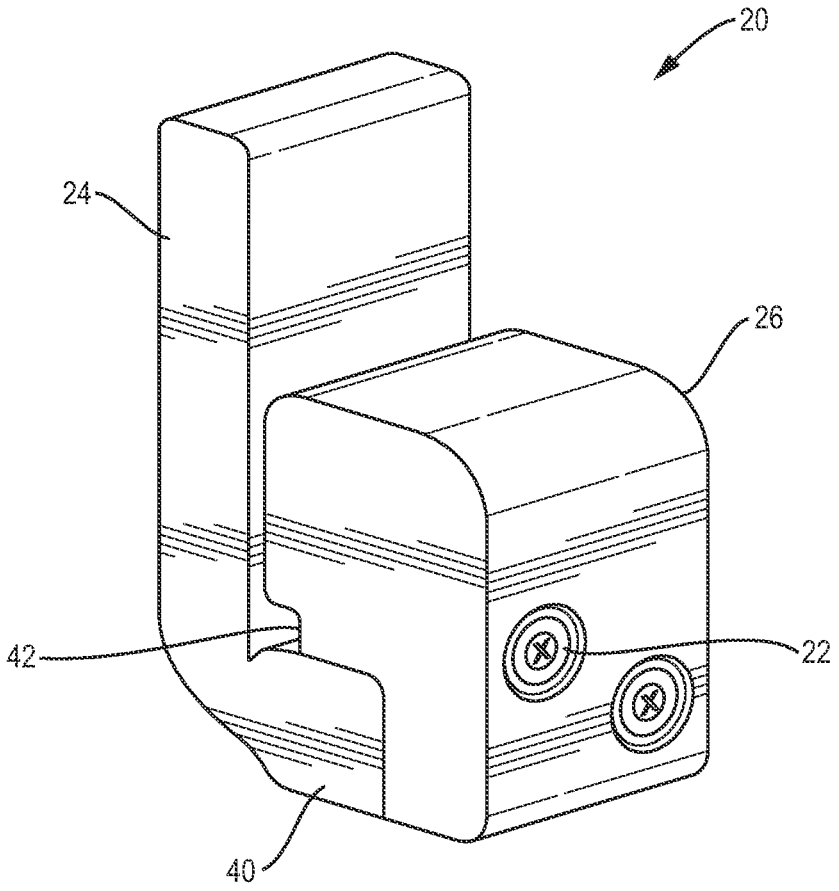
FIG. 3 is an isometric view, taken generally from the front, of an exemplary magazine safety block.
Figure 4:
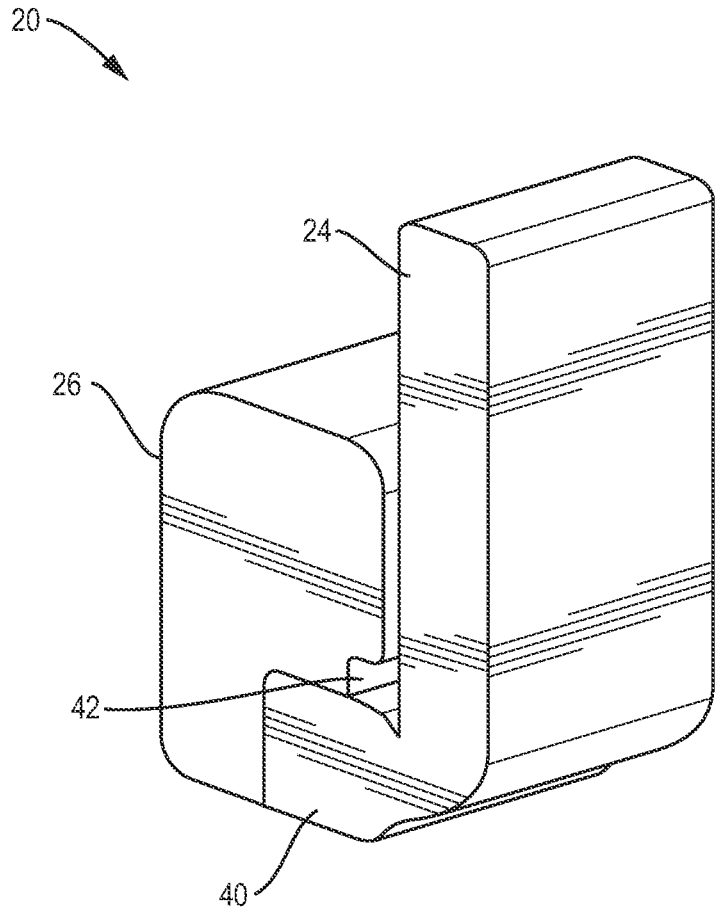
FIG. 4 is an isometric view, taken generally from the rear, of the magazine safety block appearing in FIG. 3.

FIGS. 3 and 4 are enlarged views of the block 20, which installs on the weapon 30 to prevent attaching a standard magazine 12 when the block 20 is installed. As best seen in FIG. 1, the block 20 installs onto the weapon 30 using one or more (two in the illustrated embodiment) threaded screws or bolts 22. Specifically, the block 20 includes a first, elongate, inner member 24 which is positioned inside the magazine well 32, along the inner surface of the forward facing wall 34 of the magazine well 32, which, in turn, is attached to the lower receiver 38 of the firearm. The thickness of the first member 24 is a thickness which accommodates the difference in width between the standard magazine 12 and the safety magazine 10, which, in turn, reflects the difference in length between the live cartridges 16 and the blank cartridges 14. In the illustrated preferred embodiment, the screws 22 loosen and tighten to allow mounting/clamping onto the magazine well 32 of the weapon 30. It will be recognized that other numbers of threaded fasteners 22 may be used, including 1, 3, 4, 5, etc. It will be recognized that other fastener types can be used to secure the inner and outer members in place of or in addition to the threaded fastener (s), including one or more clips, springs, including torsion springs, cam locks, and so forth.

The inner member 24 has a length which is selected according to the vertical height of the fore-end wall 34 of the magazine well 32. The inner member 24 includes a shoulder portion 40 toward its lower end (in the orientation shown in FIG. 3), the shoulder 40 extending toward the muzzle-of fore-end of the firearm. The shoulder 40 is aligned with a lower rim 36 of the magazine well 32 and accommodates the thickness of the wall 34 of the magazine well 32. The rim 36 may be a lip, flange, rolled edge, etc.

A second, outer block member 26 is secured at its lower end to the shoulder portion 40 via of the elongate block member 24 via one or more, preferably two or more (two in the illustrated embodiment) threaded fasteners 22. The inward facing surface of the outer block member 26 includes a transverse channel or groove 42 which accommodates the lower rim 36 of the magazine well 32 to provide a clasping or clamping there around. It will be recognized that the inward facing surface of one or both of the inner block member 24 and the outer block member 26 can be shaped to accommodate a particular shape of configuration of the magazine well 32 of the firearm with which the block 20 is intended to be used.

The block members 24, 26 may be made from any suitable material, such as metals, metal alloys, polymer materials, or composite materials, and for forth. The block members 24, 26 may be manufactured by any suitable method including machining, casting, molding (including injection molding), additive manufacturing, etc.

In certain embodiments, the threaded fasteners 22 may be of the type having a specific geometric configuration requiring a complementary tool to remove and/or attach the block 20. For example, the threaded fasteners 22 may have a head which requires a tool which is unique or otherwise not readily or commonly available. In this manner, the ability to remove the block 20 can be restricted to persons having the complementary tool. In certain embodiments, the threaded fasteners may be replaced with a tool-less clamping mechanism. In certain embodiments, the block members 24, 26 may be secured with a keyed locking mechanism, thus restricting the ability to remove the block 20 to persons having the key.

In certain embodiments, the inner and outer block members 24, 26 may be formed as a unitary structure configured to slip over the forward wall 34 of the magazine well 32 and to be held in place via a friction fit with the magazine well 32 fore-end wall 34 or via a snap fit with the flange or rim 36 or other complementary feature of the magazine well 32.

In certain embodiments, one or both of the inner block member 24 and the outer member 26 may utilize a bright or contrasting color to provide a visual indication to the firearm operator and others in the vicinity that the safety block 20 is attached to the weapon and, therefore, that the weapon is safe to use. Alternatively or additionally to a colored safety block 20, the safety magazine 10 housing may utilize a bright or contrasting color to provide a visual indication to the firearm operator and others in the vicinity that the magazine 10 is a safety magazine and cannot be used to inadvertently load a live round 16 or live magazine 12 into the chamber. In certain embodiments, one or more of the inner block member 24, the outer member 26, and the safety magazine 10 housing may utilize a blue color, although other colors such as yellow, red, orange, etc., are also contemplated.

In certain embodiments the block 20 members 24, 26 may be formed of a black material, transparent material (e.g., acrylic, polycarbonate, etc.), or may otherwise utilize one or more colors which render the block 20 less noticeable. Likewise, the magazine 10 may likewise utilize a color(s) selected to replicate the appearance of a standard magazine. In this manner, the safety system herein may be utilized in a situation where the use of a live cartridge would not be safe but where additional realism is desired, for example, during a theatrical production, while filming a motion picture, during a historical reenactment, and the like.

Figure 5:
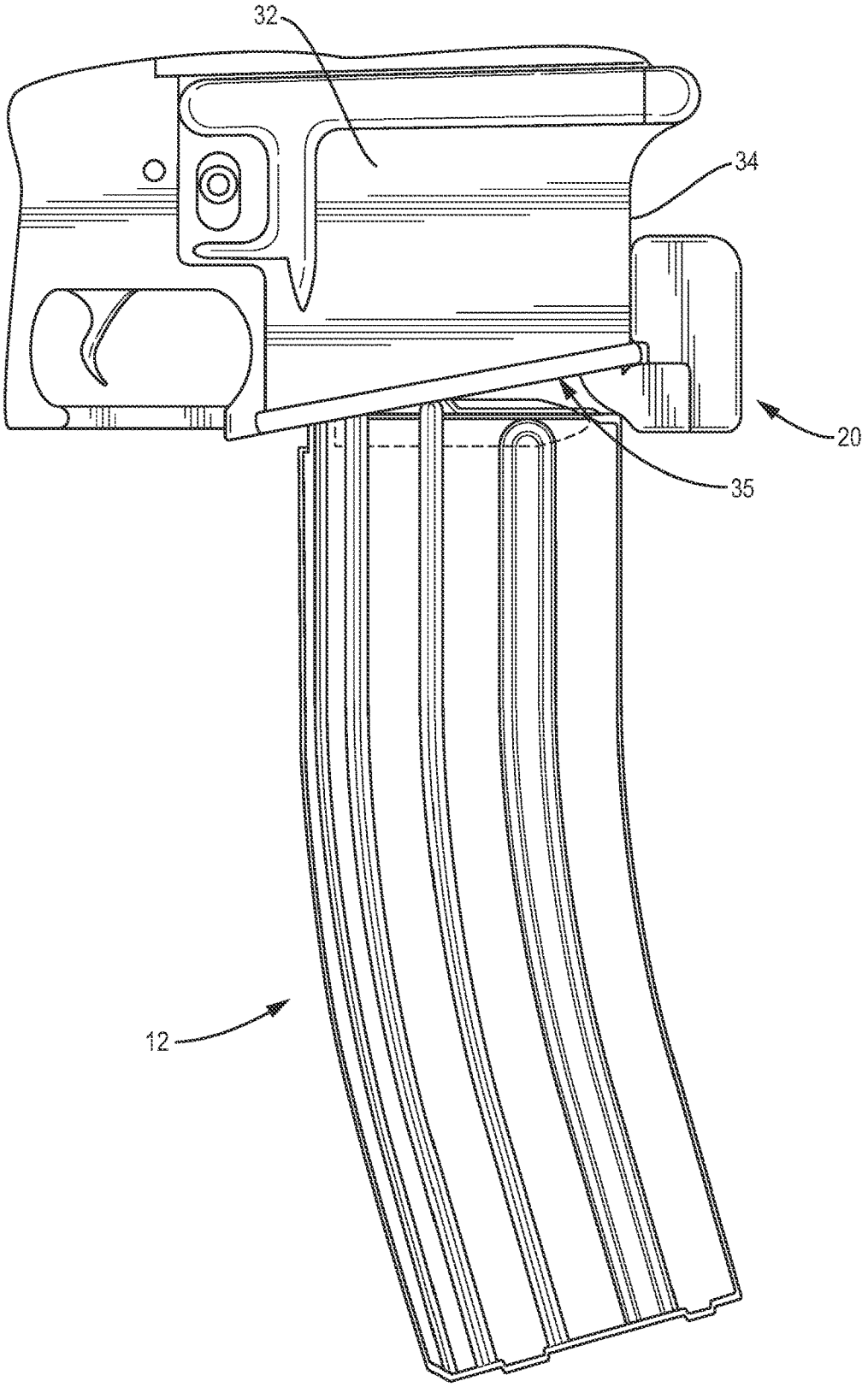
FIG. 5 illustrates the manner in which the safety block prevents insertion of a standard magazine for live ammunition rounds into the magazine well of a firearm.
Figure 6:
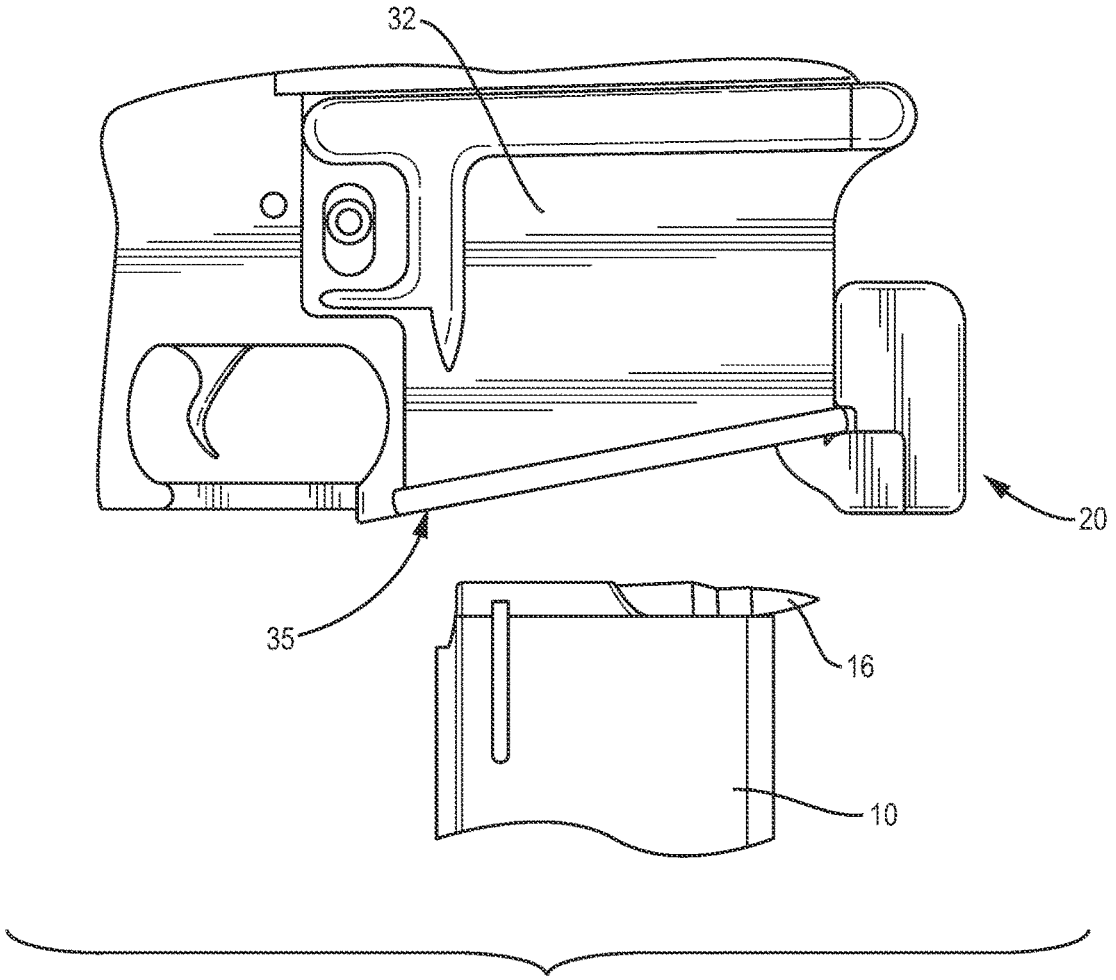
FIG. 6 illustrates the manner in which the safety block prevents insertion of the safety magazine herein if a live ammunition rounds were to be inserted into the safety magazine.

FIG. 5 depicts the manner in which the block 20 prevents a standard magazine from being loaded into the weapon 30 when the block 20 is installed. FIG. 6 depicts how a standard live round 16 could be loaded into the safety magazine 10 notwithstanding the extra length of the live round 16 as compared to the length of a blank round 14, i.e., by loading it at the top of the magazine. However, because a live round 16 loaded in the safety magazine overhangs the forward edge of the magazine, the block 20 interferes with the overhanging portion of the live cartridge if one were to attempt to insert the magazine into the magazine well 32 with the block 20 attached. Thus, the safety magazine 10 is prevented from being inserted into the magazine well 32 with a live round 16. In this manner, the present system prevents the accidental loading of a live cartridge into the magazine well 32 of the weapon 30 when it is configured for safe use with the block 20 attached, such as training or other situation where the chambering of a live round 16 would present a hazardous situation.

Figure 7:
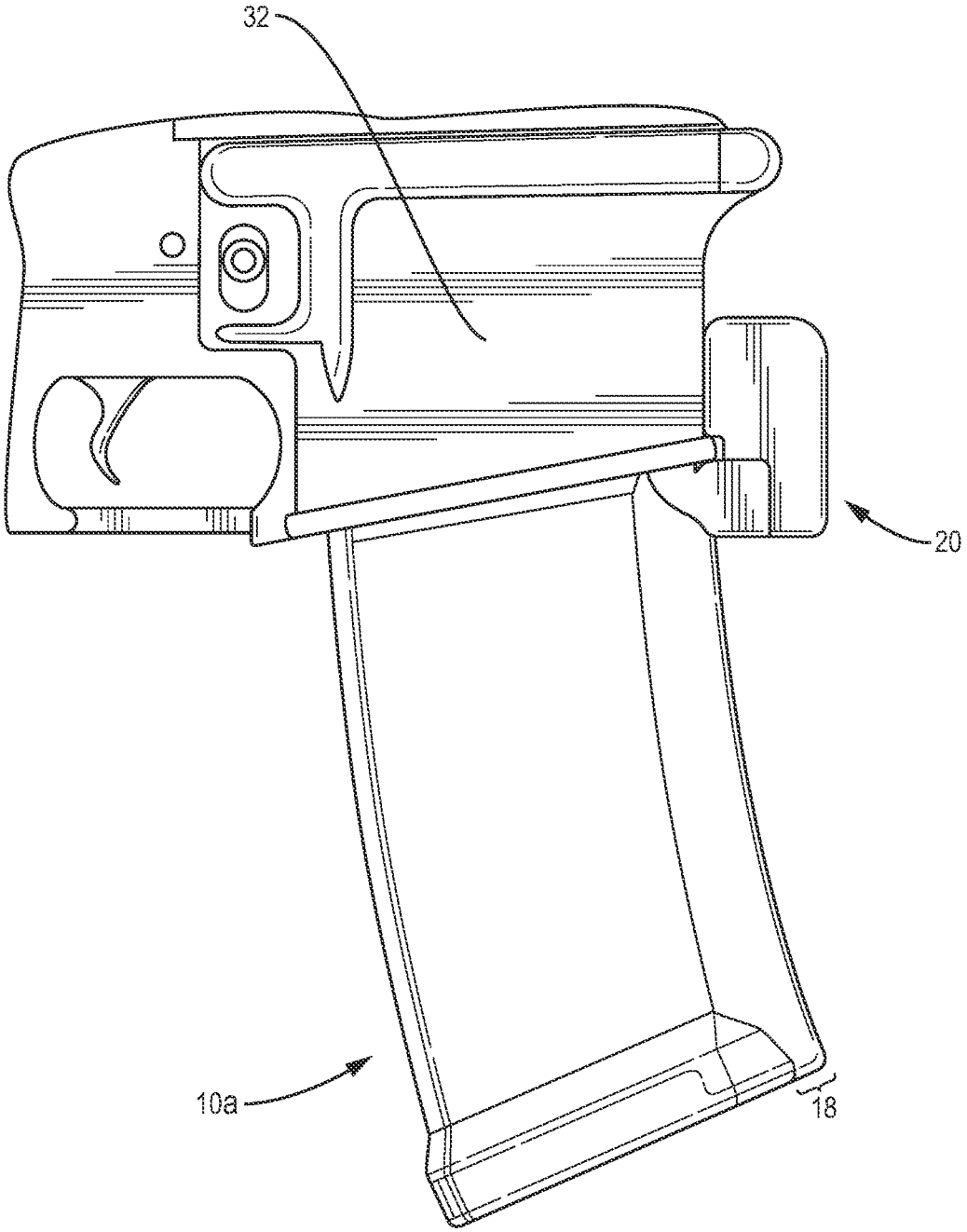
FIG. 7 illustrates an alternative embodiment safety magazine which more closely a standard magazine.

FIG. 7 depicts an alternative safety magazine system embodiment comprising a block 20 and a safety magazine 10*a* wherein the magazine 10*a* has a widened portion 18 such that the width of the portion of the safety magazine that extends below the magazine well 32 and a block 20 approximates the width of a standard magazine 12, thus defining a stepped shape. The widened portion 18 provides an additional realism and, for example, allows the safety magazine 10*a* to simulate a standard magazine 12 when used in training. The widened portion 18 may comprise additional material attached to the forward facing surface of the safety magazine 10*a*, such that the internal dimensions of the safety magazine 10*a* are unchanged. Alternatively, the safety magazine 10*a* may comprise a housing which includes the widened portion wherein a shim or filler is received within the widened portion in the housing interior, such that the internal dimensions of the cavity receiving the blanks 14 in safety magazine 10*a* are unchanged.

The invention has been described with reference to the preferred embodiment. Modifications and alterations will occur to others upon a reading and understanding of the preceding detailed description. For example, the presently disclosed embodiment depicts a safety magazine and block configured for a firearm accommodating a 5.56×45 mm NATO (5.56 NATO) cartridges. It will be recognized that the present development can be adapted for use in connection with any other caliber and with other detachable magazine types, firearms, receiver actions, and so forth. It is intended that the invention be construed as including all such modifications and alterations insofar as they come within the scope of the present claims and equivalents thereof.

The invention claimed is:

1. A magazine safety system for a firearm having a magazine well, the magazine well having a forward wall and an open end configured to insertably receive a live ammunition magazine sized to carry live ammunition cartridges having an associated caliber, the magazine safety system comprising:

a safety block configured to be removably coupled to the forward wall of the magazine well, the safety block comprising an inner block member and an outer block member;

said inner block member having a first surface configured to engage an inner surface of the forward wall of the magazine well;

said outer block member attached to the inner block member, the outer block member having a second surface opposing the first surface, the second surface configured to engage an outer surface of the forward wall of the magazine well;

one or more fasteners securing the inner block member to the outer block member, the inner block member and outer block member configured to be moved relative to one another in response to manipulation of said one or more fasteners to capture the forward wall of the magazine well between the inner block member and the outer block member in clamping fashion;

the inner block member having a thickness configured to reduce an axial extent of the open end by an amount sufficient to permit insertion of a blank ammunition magazine sized to carry blank ammunition cartridges having the associated caliber, the blank ammunition cartridges having a length which is less than the live ammunition cartridges having the associated caliber, the thickness further configured to prevent insertion of the live ammunition magazine.

2. The magazine safety system of claim 1, further comprising the blank ammunition magazine.

3. The magazine safety system of claim 2, wherein the blank ammunition magazine is a box-type magazine.

4. The magazine safety system of claim 2, wherein the blank ammunition magazine has a stepped shape defining a first portion sized to fit within the magazine well when the safety block is secured to the forward wall of the magazine well and a second portion wider than the first portion which is exterior to the magazine well when the safety block is secured to the forward wall of the magazine well.

5. The magazine safety system of claim 1, wherein the inner block member includes a shoulder portion which is exterior of the magazine well and extends toward the outer block member when the safety block is secured to the forward wall of the magazine well.

6. The magazine safety system of claim 5, wherein the outer block member includes a transversely extending groove configured to accommodate a rim of the magazine well when the safety block is secured to the forward wall of the magazine well.

7. The magazine safety system of claim 1, wherein the inner block member and outer block member are formed of a material selected from the group consisting of metals, metal alloys, polymer materials, and composite materials.

8. The magazine safety system of claim 1, wherein said one or more fasteners comprise one or more threaded fasteners securing the inner block member to the outer block member.

9. The magazine safety system of claim 8, wherein said one or more threaded fasteners have a specific geometric configuration requiring a complementary tool to attach and remove the safety block from the forward wall of the magazine well.

10. The magazine safety system of claim 1, wherein one or both of the inner block member and outer block member have a color selected from the group consisting of a bright color, a color which is contrasting with a color of the firearm, and a color which is indicative of safety.

11. The magazine safety system of claim 10, wherein one or both of the inner block member and outer block member are blue in color.

12. The magazine safety system of claim 1, wherein one or both of the inner block member and outer block member are formed of a material which is transparent.

13. A method for preventing loading of a live ammunition cartridge into a firing chamber of a firearm, the firearm having an associated caliber, the firearm further having a magazine well, the magazine well having a forward wall and an open end configured to insertably receive a live ammunition magazine sized to carry live ammunition cartridges having the associated caliber, the method comprising:

placing an inner block member along an inner surface of the forward wall of the magazine well of the firearm;

placing an outer block member along an outer surface of the forward wall of the magazine well of the firearm;

attaching the inner block member to the outer block member with one or more fasteners and manipulating the one or more fasteners to clamp the forward wall of the magazine well between the inner block member and the outer block member; and wherein the inner block member has a thickness configured to reduce an axial extent of the open end by an amount sufficient to permit insertion of a blank ammunition magazine sized to carry blank ammunition cartridges having the associated caliber, the blank ammunition cartridges having a length which is less than the live ammunition cartridges having the associated caliber, the thickness further configured to prevent insertion of the live ammunition magazine.

* * * * *